United States Patent [19]

Schaper

[11] Patent Number: 4,487,126

[45] Date of Patent: Dec. 11, 1984

[54] SAFETY FUSE WITH AUTOMATIC UNDERWATER SELF-DISARMING

[75] Inventor: Hermann Schaper, Vallendar, Fed. Rep. of Germany

[73] Assignee: Rheinmetall GmbH, Duesseldorf, Fed. Rep. of Germany

[21] Appl. No.: 472,003

[22] Filed: Mar. 4, 1983

[30] Foreign Application Priority Data

Mar. 4, 1982 [DE] Fed. Rep. of Germany ..... 3207700

[51] Int. Cl.[3] ..... F42C 3/00; F42C 5/00

[52] U.S. Cl. ..... 102/229; 102/223; 102/392; 102/416

[58] Field of Search ..... 102/229, 230, 223, 392, 102/406, 408, 416

[56] References Cited

U.S. PATENT DOCUMENTS

| | | | |
|---|---|---|---|
| 3,015,270 | 1/1962 | Domingos et al. | 102/392 |
| 3,368,488 | 2/1968 | Johnson et al. | 102/416 X |
| 3,765,331 | 10/1973 | Montesi | 102/416 |
| 4,056,058 | 11/1977 | Laguna de Rins | 102/392 |
| 4,311,097 | 1/1982 | Backstein et al. | 102/229 |
| 4,369,709 | 1/1983 | Backstein et al. | 102/229 |

*Primary Examiner*—David H. Brown

[57] ABSTRACT

A pressure-actuated fuse has a housing formed with an inner chamber and with a passage having an outer end opening to the exterior and an inner end opening into the chamber. A plug in the passage has a porosity sufficient to allow slow liquid flow through itself. An actuating element is exposed inwardly in the chamber and outwardly to the exterior and is displaceable in the housing by a pressure differential between the chamber and the exterior along an actuating axis between an outer position and an inner position. The chamber is substantially closed to the exterior except through the passage. A valve in the passage connected to the actuating element blocks liquid flow along the passage only when the actuating element is in its outer position. Thus, when the element moves out of its outer position liquid can flow through the plug and limitedly along the passage into the chamber. A spring braced between the housing and the actuating element urges it into its outer position so that only when the exterior pressure effective inwardly on the element is greater than the spring force can the element move into its inner position. A firing member is displaceable in the housing into firing position engaging and exploding a detonator therein. A link mechanism blocks the firing member from moving into the firing position except when the actuating element is in its inner position. Thus the interior of the device is cut off from the outside until the actuating member moves into its inner position, which normally only is when the device has been submerged fully.

12 Claims, 3 Drawing Figures

SAFETY FUSE WITH AUTOMATIC UNDERWATER SELF-DISARMING

FIELD OF THE INVENTION

The present invention relates to a pressure-actuated fuse. More particularly this invention concerns such a fuse equipped with a system that automatically disarms it after it is underwater for a predetermined time without firing.

BACKGROUND OF THE INVENTION

An underwater fuse is known which sets off a charge it is attached to when the charge is a predetermined depth underwater. Such a fuse is used in a charge for military use or for use in underwater surveying and prospecting. Typically the fuse is constructed so that it is armed by removal of a firing pin, and that before such arming it cannot be set off, even if dropped overboard.

In U.S. Pat. No. 4,311,097 such a fuse is described which has a primary fuse that operates at a relatively shallow depth to position a detonator in line with a firing pin and a secondary fuse that responds at a greater depth and operates the firing pin to explode the detonator. A releasable safety mechanism normally prevents operation of the primary fuse. The secondary fuse cannot operate until the primary fuse has operated so that successive operation of the two fuses is necessary to set off the detonator. In addition, the two fuses operate along mutually perpendicular axes so accidental jarring of the device cannot fire it.

In order to automatically self-disarm this fuse, it is constructed so that the housing will leak slightly. Normally the fuses are operated by respective diaphragms that are outwardly exposed to the surrounding air or water and that are internally exposed in a common inner chamber filled with air. Slow liquid leakage into this inner chamber is expressly provided for so that if the device does not go off, for instance when it is dropped in water that is too shallow, the inner chamber will slowly fill up and equalize pressure on the diaphragms, thereby moving both of the fuses into the outer positions in which the detonator is not even in line with the firing pin which itself is locked in place. The disarmed device will of course become useless as it wets the springs and the internal mechanism rusts and its charge is soaked.

The leakage required to do this must be relatively slow so that the device does not disarm itself in regular use, but still must be certain so that after a certain time underwater the charge can be counted on to be dead. Such controlled leakage was generally obtained by plugging a passage extending between the outside and the inner chamber with a piece of heavy felt. This material is generally gas- and water-impervious, but will soak through and leak with time.

The problem with this arrangement is that if oil or the like got on the felt it became wholly impervious and did not permit leakage at all. Similarly other factors could make it more pervious so that when dropped overboard the device would fill up and disarm itself before it had fallen to the depth at which it was supposed to go off.

Another problem with such an arrangement was that it allowed some moisture into the fuse. Normally occurring barometric and temperature changes cause the inner chamber to breathe through the felt plug. For instance if transported in an airplane the device would breathe out its internal pressure when taken up and would breathe in through the plug on landing. This could introduce moisture-laden air into the interior of the fuse, possibly dampening the charge and rusting the internal components. Furthermore if the charge was exposed to moisture on shipboard, as is common, some liquid could simply soak through the felt plug and make its way into the mechanism.

OBJECTS OF THE INVENTION

It is therefore an object of the present invention to provide an improved autodisarming system for a safety fuse.

Another object is the provision of an autodisarming system for a safety fuse which overcomes the above-given disadvantages.

Yet another object is to provide such a system which will automatically and surely disarm the fuse after a predetermined time underwater, yet which will not permit the penetration of water into the fuse unless it is well submerged.

SUMMARY OF THE INVENTION

These objects are attained according to the instant invention in a pressure-actuated fuse having a housing formed with an inner chamber and with a passage having an outer end opening to the exterior and an inner end opening into the chamber. A plug in the passage has a porosity sufficient to allow slow liquid flow through itself. An actuating element is exposed inwardly in the chamber and outwardly to the exterior and is displaceable in the housing by a pressure differential between the chamber and the exterior along an actuating axis between an outer position and an inner position. The chamber is substantially closed to the exterior except through the passage. A valve in the passage connected to the actuating element blocks liquid flow along the passage only when the actuating element is in its outer position. Thus when the element moves out of its outer position liquid can flow through the plug and limitedly along the passage into the chamber. A spring braced between the housing and the actuating element urges it into its outer position so that only when the exterior pressure effective inwardly on the element is greater than the spring force can the element move into its inner position. A firing member is displaceable in the housing into a firing position engaging and exploding a detonator therein. A link mechanism blocks the firing member from moving into the firing position except when the actuating element is in its inner position.

With this system, therefore, the interior of the device is cut off from the outside until the actuating member moves into its inner position, which normally only is when the device has been submerged a certain depth. This arrangement is usable in an arrangement having a second actuating element separate from the first-mentioned element, exposed inwardly in the chamber and outwardly to the exterior, and displaceable in the housing by pressure differential between the chamber and the exterior along a second actuating axis transverse to the first-mentioned axis between an outer position and an inner position. Second spring means braced between the housing and the second actuating element urges same into its outer position so that only when the exterior pressure effective inwardly on the element is greater than the spring force can the second element move into its inner position. A second link mechanism blocks the first element from moving into its inner position except when the second element is in its inner position. In this manner the low-pressure or shallow-depth actuator is linked to the valve to open it, so that only when this depth is reached will it open and will leakage commence. It could be linked to the high-pressure actuator also for later response.

To make the dual fuse substantially safe even if jarred the first and second axes are generally perpendicular to each other. In this manner even if the mechanism was struck in a direction parallel to the axis of one of the actuators hard enough to cause it to move inertially, the other would not move, being transverse to the external force. Since both must move, and in a certain sequence, for the firing mechanism to be actuated, accidental firing is therefore ruled out.

For accurately controlled leakage the plug is of sintered metal. This material is particularly suited to this type of operation, and its resistance to flow is largely constart and unaffected even when wet.

The fuse according to this invention also has a valve seat formed in the passage and directed transversely away from the actuating axis, a valve body movable transversely of the axis between a blocking position sealingly engaging the seat to block the passage and relatively close to the axis and a freeing position out of engagement with the seat for flow through the passage and relatively far from the axis, and operating means engaged between the valve body and the actuating element for displacing the body into the freeing position on displacement of the element out of the outer position. In this case the actuating element includes a slide displaceable with the actuating element along the actuating axis and formed with a radially directed camming formation and the operating means includes a projection extending from the valve body toward the slide and engageable with the camming formation.

The valve body is movable between its positions along a valve axis generally radial of the actuating axis and the projection extends along the valve axis toward the slide from the valve body. The valve means further comprises an annular seal engageable between the seat and the body and the projection extends through the seal. For tightest closure the valve means has an annular seal engageable between the seat and the body and the projection extends through the seal. An O-ring makes a tight joint while presenting little resistance to opening of the valve.

To hold the valve closed a spring is braced between the valve body and the housing and urges the valve body into the blocking position. The valve body itself is snugly received and slidable in the passage between its positions and is formed with at least one full-length cutout along which liquid can flow in the passage around the valve body.

As is known the actuating element is a flexible diaphragm. The large surface area of such an element makes it easy for it to respond accurately to a temperature within a very narrow range.

DESCRIPTION OF THE DRAWING

The above and other features and advantages will become more readily apparent from the following, reference being made to the accompanying drawing in which.

SPECIFIC DESCRIPTION

Figure 1:
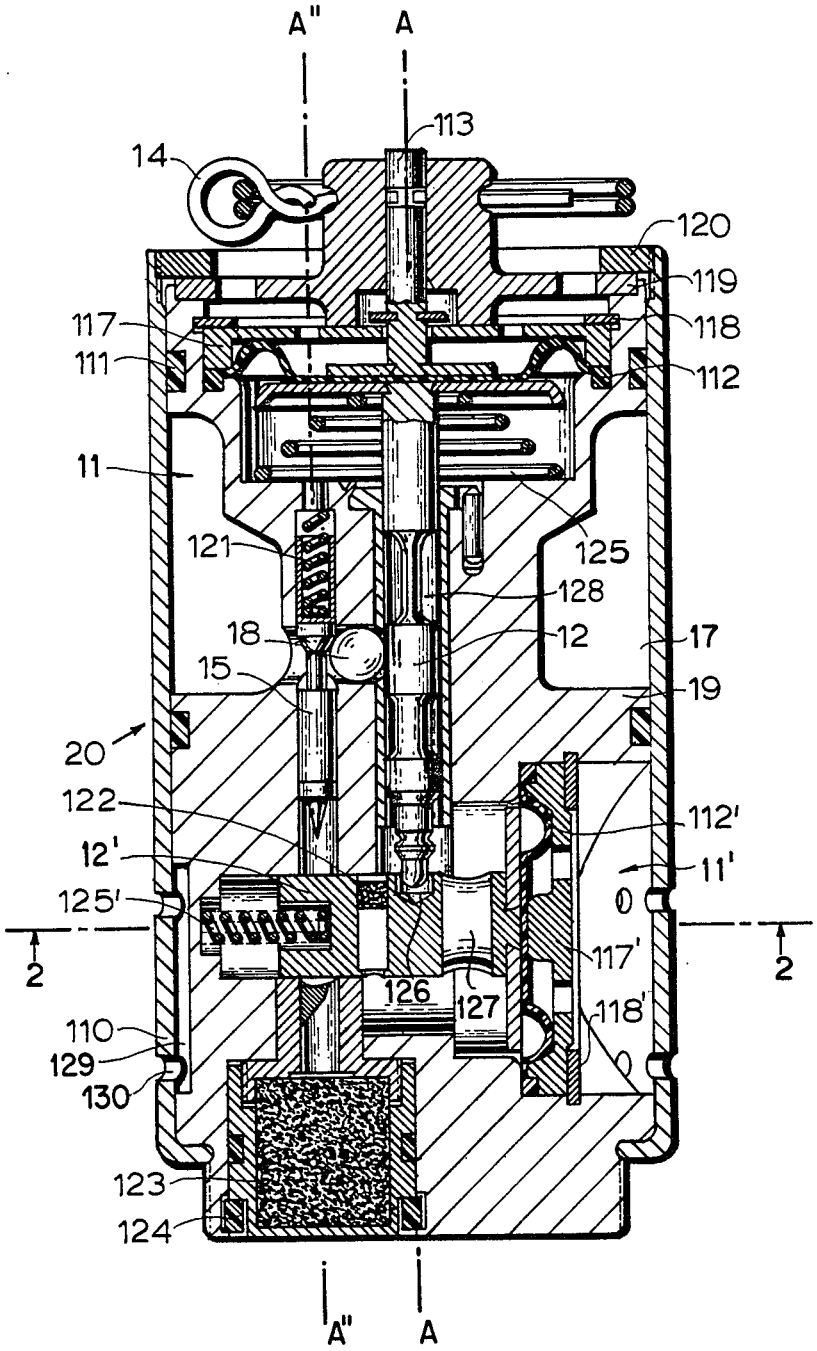
FIG. 1 is an axial section through the fuse according to the invention.
Figure 2:
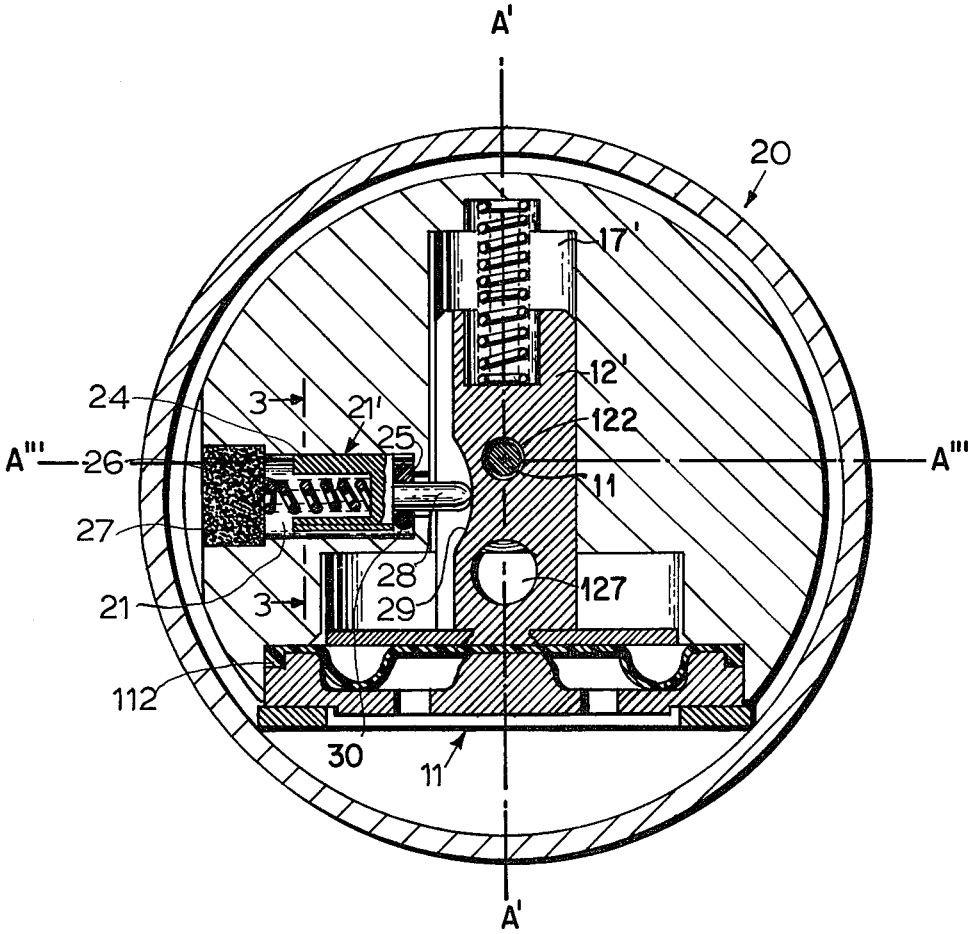
FIG. 2 is a reaction taken along line II—II of FIG. 1.

As seen in FIGS. 1 and 2 the fuse 20 of this invention has a cylindrical outer housing sleeve 110 centered on a housing axis A and fitted tightly around a core or housing 19 that forms with it a chamber 17 sealed by O-rings 111. A threaded ring 120 locks the core 10 in the sleeve 110.

High-pressure and low-pressure fuses 11 and 11' have respective diaphragms 112 and 112' that are pinched against the core under respective snap rings 118 and 118' and that underlie respective abutment sieve plates 117 and 117'. Respective springs 125 and 125' urge these diaphragms 112 and 112' into respective outer positions in the manner described in the above-cited patent, to which reference can be made for more construction details of this dual safety fuse.

The low-pressure fuse 11' has a slide 12' that is movable along an axis A' perpendicular to the axis A and is fitted with a detonator or primer charge 122 that can ignite a further charge 123 secured in the bottom of the device by a ring 124. The entire mechanism according to this invention is in use screwed into the top of an appropriate charge that is ignited in turn by the charge 123. Displacement of the diaphragm 112' and its slide 12' from the illustrated outer position toward the left against the force of its spring 125' moves the detonator 122 into alignment along an axis A'' between a firing pin 15 and the charge 123. This slide 12' is formed with a shallow recess 126 and with a throughgoing bore 127 alignable with the axis A in the outer and inner positions, respectively.

The high-pressure fuse 11 has a slide 12 movable along the axis A and having a tip engageable in either of the formations 126 or 127, depending on the position of the slide 12'. When the formation 126 is aligned with the tip of the slide 12 the respective diaphragm 112 cannot move from the illustrated intermediate position into the inner position, down in the drawing. When the bore 127 is aligned with the slide 12 it can move down into this inner position.

The slide 12 further has a central region engageable with a ball 18 that engages in a groove of the firing pin 15 to hold it against displacement along its axis A'' by its spring 121.

In addition a safety pin or stop 113 that can be axially arrested by a pullout pin 14 in an end plate 119 of the housing 110, 19 can prevent movement of the diaphragm 112 from the illustrated intermediate posiion to its outer position, up in the drawing. In the illustrated position, therefore, the slide 12' is locked against movement in either direction along its axis A' by the slide 12 whose tip is engaged in its recess 126. The slide 12 in its turn is locked against movement inwardly by bottoming of its tip in the shallow recess 126 and in the opposite direction by the stop pin 113. Thus the whole system is effectively locked up, with the detonator 122 out of alignment with the pin 15. In this position the fuse can be given very rough handling with virtually no chance of exploding.

If the safety pin 14 is withdrawn the spring 125 will push up the diaphragm 112. This action pushes the pin 113 up out of the housing, giving a visible and feelable indication that the fuse is off safety. In addition such action pulls the tip of the slide 12 out of the recess 126, so that the slide 12' can move along its axis A'. Under normal circumstances with atmospheric pressure on both sides of the diaphragms 112 and 112', these elements will be in their outer positions. Thus in this position the slide 12' is free to move axially, but the slide 12 is still limited by the bottom of the recess.

The fuse 20, attached to an appropriate charge, is then dropped overboard into water deeper than its rated exploding depth. Water pressure on the diaphragms 112 and 112' will first push the diaphragm 112' and its slide 12' inwardly until the charge 122 is aligned with the axis A'' and the hole 127 with the axis A. Further descent underwater will then move the diaphragm 112 and its slide 12 axially inward. This movement pushes the tip of the slide 12 through the bore 127, and aligns a radially outwardly open groove 128 of the slide 12 with the ball 18. The spring 121 can then cam this ball 18 out of the way and drive the pin 15 into the detonator 122 to explode the device.

The tolerances of the various elements in the above-described structure are such that the same pressure reigns throughout inside it and inside the chamber 17. Thus ambient atmospheric pressure is substantially captured inside the device.

As seen in FIG. 2, in order to disarm the arrangement after it has spent some time underwater, the housing core 19 is formed with a stepped bore 21 extending along an axis A''' perpendicular to the axis A' and to the plane of the axes A and A'. At its outer end the bore 21 opens at an annular radially outwardly open groove 129 formed in the core 19 and open to the outside through holes 130 on the shell 110. At its inner end the bore 21 opens into the passage 17' in the core 19 in which the slide 12' moves.

A sintered-metal plug 27 closes off the outside of this passage or bore 21 so that at best air and liquid flow into the chamber defined by the housing 19 and housing sleeve, 110 and containing all the critical operating structure, will be limited. Sintered metal is very accurately rated for such flow, however, and the plug 27 can be counted on to permit a very precisely determined flow, whether wet or dry.

A cup-shaped valve body 24 is urged into sealing contact with a valve seat 30 formed by a shoulder in the stepped passage 21 by a spring 26 braced between this body 24 and the plug 27. The valve cup 24 has an operating pin 28 extending along the axis A''' into the passage 127. An O-ring surrounds this pin 28 and ensures that in the illustrated blocking position fluid flow inwardly into the passage 17' is wholly blocked.

The slide 12' is formed with a groove extending along and open radially of the axis A', and the groove has a deep camming region 29. The pin 28 engages in the deep region 29 when the diaphragm 112' is in the illustrated outer position of FIG. 2, and the valve body 24 is in the blocking position wholly cutting off fluid flow past the seat 30.

Figure 3:
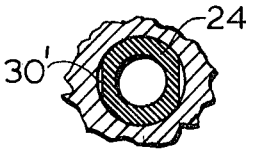
FIG. 3 is a section taken along line III—III of FIG. 2.

Movement of the diaphragm 112 and slide 12' out of the outer position pushes the valve body 24 out, away from the seat 30. Since as shown in FIG. 3 the body 24 has sides formed with flats 30', this action permits fluid flow along the passage 21, which flow is of course limited by the semipervious plug 27.

Thus so long as the low-pressure fuse 11' is not actuated, that is its diaphragm 112' is in the outer position, the inside of the device is cut off from the exterior. Moisture-laden air cannot even enter the device to rust its parts and degrade the charge. Once moved out of this inner position, however, carefully regulated leakage through the plug 27 can slowly fill the interior of the device.

In this manner if for some reason the fuse does not go off, for instance because it is in water that is too shallow to operate the high-pressure fuse 11, the interior of the device will slowly fill with water. Pressure to both sides of the diaphragms 112 an 112' will therefore equalize so they will both move into and/or stay in their outer positions. Even if subsequently the device moves into deeper water it will not be able to go off. After some time the invading water will rust out the mechanism and saturate the charge, making the device wholly nonfunctional. In this manner an old charge will represent no danger.

Prior to use, however, the device can be exposed to water, and even immersed in water without anything leaking into it so long as it does not be below the rated depth of the actuator diaphragm operating the bleed valve. Since the safety 113 holds the tip of the slide 12 in the recess 126, retaining the slide 12' in the outer position, the passage 21' is effectively blocked off.

We claim:

1. A pressure-actuated fuse comprising:

a housing formed with an inner chamber and with a passage having an outer end opening to the exterior and an inner end opening into the chamber;

a plug in the passage having a porosity sufficient to allow slow liquid flow through itself;

an actuating element exposed inwardly in the chamber and outwardly to the exterior and displaceable in the housing by a pressure differential between the chamber and the exterior along an actuating axis between an outer position and an inner position, the chamber being substantially closed to the exterior except through the passage;

valve means in the passage and connected to the actuating element for blocking liquid flow along the passage only when the actuating element is in its outer position, whereby when the element moves out of its outer position liquid can flow through the plug and limitedly along the passage into the chamber;

spring means braced between the housing and the actuating element for urging same into its outer position, whereby only when the exterior pressure effective inwardly on the element is greater than the spring force can the element move into its inner position;

a detonator in the housing;

a firing member in the housing displaceable into a firing position engaging and exploding the detonator; and link means for blocking the firing member from moving into the firing position except when the actuating element is in its inner position.

2. The fuse defined in claim 1 wherein the plug is of sintered metal.

3. The fuse defined in claim 1 wherein the actuating element is a flexible diaphragm.

4. The fuse defined in claim 1, further comprising:

a second actuating element separate from the first-mentioned element, exposed inwardly in the chamber and outwardly to the exterior, and displaceable in the housing by a pressure differential between the chamber and the exterior along a second actuating axis transverse to the first-mentioned axis between an outer position and an inner position;

second spring means braced between the housing and the second actuating element for urging same into its outer position, whereby only when the exterior pressure effective inwardly on the element is greater than the spring force can the second element move into its inner position; and second link means for blocking the first element from moving into its inner position except when the second element is in its outer position.

5. The fuse defined in claim 4 wherein the first and second axes are generally perpendicular to each other.

6. The fuse defined in claim 1 wherein the valve means includes:

a valve seat formed in the passage and directed transversely away from the actuating axis;

a valve body movable transversely of the axis between a blocking position sealingly engaging the seat to block the passage and relatively close to the axis and a freeing position out of engagement with the seat for flow through the passage and relatively far from the axis; and operating means engaged between the valve body and the actuating element for displacing the body into the freeing position on displacement of the element out of the outer position.

7. The fuse defined in claim 6 wherein the valve means further comprises an annular seal engageable between the seat and the body, the projection extending through the seal.

8. The fuse defined in claim 6 wherein the valve means further includes a spring braced between the valve body and the housing and urging the valve body into the blocking position.

9. The fuse defined in claim 6 wherein the valve body is snugly received and slidable in the passage between its positions and is formed with at least one full-length cutout along which liquid can flow in the passage around the valve body.

10. The fuse defined in claim 6 wherein the actuating element includes a slide displaceable with the actuating element along the actuating axis and formed with a radially directed camming formation, the operating means including a projection extending from the valve body toward the slide and engageable with the camming formation.

11. The fuse defined in claim 10 wherein the valve body is movable between its positions along a valve axis generally radial of the actuating axis of the first actuating element, the projection extending along the valve axis toward the slide from the valve body.

12. The fuse defined in claim 11 wherein the valve means further comprises an annular seal engageable between the seat and the body, the projection extending through the seal.

* * * * *